United States Patent [19]

Hughes

[11] 4,253,012

[45] Feb. 24, 1981

[54] ELECTRICAL HEATING UNITS

[75] Inventor: John Hughes, Worcestershire, England

[73] Assignee: Micropore International Limited, Droitwich, England

[21] Appl. No.: 39,526

[22] Filed: May 16, 1979

Related U.S. Application Data

[63] Continuation of Ser. No. 838,025, Sep. 29, 1977, abandoned.

[30] Foreign Application Priority Data

Sep. 30, 1976 [GB] United Kingdom ..... 40673/76

[51] Int. Cl.[3] ..... H05B 3/76

[52] U.S. Cl. ..... 219/467; 219/461; 219/354; 219/355

[58] Field of Search ..... 219/443, 451, 456, 457, 219/458, 459, 460, 463, 464–468, 542; 338/296, 297, 304, 278, 279, 282

[56] References Cited

U.S. PATENT DOCUMENTS

| | | | |
|---|---|---|---|
| 563,032 | 6/1896 | Hadaway | 219/468 |
| 747,185 | 12/1903 | Kelley et al. | 219/375 |
| 1,152,950 | 9/1915 | Hoke | 219/451 |
| 2,164,650 | 7/1939 | Goldthwaite . | |
| 2,490,602 | 12/1949 | Schick | 219/342 |
| 2,943,178 | 6/1960 | Aldous . | |
| 2,955,190 | 10/1960 | Kelly | 219/459 |
| 3,819,903 | 6/1974 | Frick . | |
| 3,833,793 | 9/1974 | McWilliams et al. | 219/459 |
| 4,057,670 | 11/1977 | Scheidler | 219/464 |

FOREIGN PATENT DOCUMENTS

| | | | |
|---|---|---|---|
| 44790 | 10/1931 | Denmark | 219/451 |
| 259021 | 9/1911 | Fed. Rep. of Germany . | |
| 520611 | 3/1931 | Fed. Rep. of Germany . | |
| 1024181 | 7/1958 | Fed. Rep. of Germany . | |
| 2246118 | 3/1974 | Fed. Rep. of Germany . | |
| 2195145 | 1/1974 | France . | |
| 21557 | of 1910 | United Kingdom | 219/455 |
| 285177 | 2/1928 | United Kingdom . | |
| 372813 | 5/1932 | United Kingdom . | |
| 1433478 | 4/1976 | United Kingdom . | |

*Primary Examiner*—B. A. Reynolds
*Assistant Examiner*—Bernard Roskoski
*Attorney, Agent, or Firm*—Pollock, Vande Sande & Priddy

[57] ABSTRACT

Described herein is an electrical heating unit for smooth top cookers. The unit comprises a heating element in the form of a spiral coil of bare wire which has then been helically rolled together with a strip of flexible thermal and electrical insulation such as a ceramic paper around a central core. The resulting rolled structure is some-what analogous to a "Swiss roll". This structure rests on and is supported on a base layer of thermal and electrical insulation which is desirably dish-shaped and contained an outer metal pan for earthing and mechanical protection. The rolled structure is retained in its configuration and held against the base layer by a number of spoke-like members of heat resistant and electrically insulating material across the top of the element.

21 Claims, 2 Drawing Figures

ELECTRICAL HEATING UNITS

This is a continuation of application Ser. No. 838,025, filed Sept. 29, 1977, now abandoned.

This invention relates to electrical heating units for smooth top cookers.

BACKGROUND TO THE INVENTION

Smooth top cookers such as stoves and the like have a flat sheet of, for example, a glass ceramic which forms the actual heating surface upon which a cooking utensil is placed and a heating unit which includes a heating element disposed below the glass ceramic sheet. The sheet must be capable of transferring the heat from the heating unit to the cooking utensil and of withstanding the very high temperatures without softening or cracking. Such designs have advantages of easy cleaning over cookers in which the cooking utensil is heated by direct radiation or direct contact with a heating element.

The electrical heating unit described in our U.K. Pat. No. 1,433,478 has proved extremely successful in practice and has been found to have a relatively high efficiency, a relatively short response time to temperature control adjustment and a long life. As described in that patent the heating element coil is held in its helical shape by staples which are anchored in a base layer of thermal and electrical insulation. In order to ensure adequate anchoring of the staples the insulation has to be quite thick, often more than would be necessary for thermal insulation purposes. Therefore the overall depth of the heating units shown in that patent is usually relatively large. This is not a problem in many designs of cooker but, where the smooth top cooking unit is combined into a design in which the electrical controls project under the edge of the stove, the overall depth of the heating units can be such that they may interfere with the electrical controls.

It is therefore an object of this invention to provide an electrical heating unit which can have a smaller overall depth.

BRIEF SUMMARY OF THE INVENTION

According to the invention there is provided an electrical heating unit for a smooth top cooker comprising a heating element in the form of a helix (as hereinafter defined) of a spirally coiled bare wire, the helix having been formed by rolling the spirally coiled wire together with a flexible, heat resistant and electrically insulating strip around a core so that adjacent convolutions of the helix are separated by the insulating strip, the heating element resting on and being supported by a base layer of thermal and electrical insulating material, and being retained in its substantially helical configuration by a number of spoke-like members of heat resistant and electrically insulating material extending over the top of the element.

With such a unit we find that the thickness of thermal and electrical insulation required for the base layer to support and insulate the heating element can be the minimum necessary for thermal and electrical insulation and in general this means that the heating unit can be of less overall thickness or depth than the heater shown in our above noted Patent. In addition the manufacture of such a heating unit can be a relatively straight forward and quick operation with reduced hand assembly.

When the spirally coiled bare wire heating element is energised there is only a very low thermal mass, apart from the wires, which become very hot. Accordingly the heating unit of the invention has a short response time to temperature control adjustments and is relatively efficient in its use of electrical energy, particularly as compared with heating units in which the bare wire rests in a spiral groove.

The helically wound heating element is formed by winding a spirally coiled bare wire and a flexible strip of heat resistant electrical insulation material around a ceramic core. The width of the flexible strip should approximate the diameter of coiling of the bare wire so as to give a substantially flat coiled heating element with adjacent convolutions of the bare wire electrically insulated from one another by the insulating strip. The winding is continued until a helix of the desired size and the desired length of wire have been obtained.

If the core is circular, the winding of the element and insulation material will give a helix whose overall shape is substantially circular. This is not essential, however, and heating units of various overall shapes are possible. Thus, the core can be substantially square or rectangular and then the winding will give an overall shape which is square or rectangular with rounder edges. Alternatively the core would be D-shaped to give a corresponding shaped unit. Therefore the term "in the form of a helix" as used herein is to be construed as including the winding of the wire and insulating material in a shape which is not a strict geometrical helix.

Since adjacent convolutions of the helix of the bare wire will be at relatively small potential differences from one another, the strip of flexible electrically insulating material can be quite thin yet still provide satisfactory electrical insulation. Therefore adjacent convolutions of the bare wire can be relatively close and so a very concentrated heat source is possible and, provided an appropriate temperature limited is used to protect the glass ceramic sheet, very high watt densities are possible.

The adjacent convolutions of the bare wire can generally be closer than is possible with prior units. Accordingly one can if desired use a longer length of thinner electrical resistance wire with an overall saving in material or stretch out the spiral coil which is helically wound to form the element. Also, one can if desired provide two quite separate heating elements. Thus according to one embodiment there can be an inner element for use with cooking utensils of relatively small diameter and a surrounding outer substantially annular element which need only be brought into operation when the cooking utensil is of large diameter. Double element heating units are well known for traditional tubular heating units and it is therefore an advantage of the invention that with the heating units of the invention one can provide an analogous arrangement for smooth top cookers. Alternatively according to another embodiment the two coils may be in the form of a pair of co-centric interleaved helices.

The flexible electrical insulation material of the strip must be capable of withstanding the red radiant heat temperatures of the coiled bare wire heating element and an example of a suitable material is ceramic paper made of alumino-silicate. This ceramic paper can be about 2 mm thick although its thickness can range, for example, from 0.5 to 4 mm.

The spoke-like members which extend across the heating element to retain it flat against the base layer of thermal and electrical insulation may be anchored both at the centre and at the edges of the helix of the heating element. If they are sufficiently rigid, however, they may be firmly anchored only at the centre of the heating element.

According to one embodiment of the invention separate radially arranged members are provided which are held both at the centre of the heating element against the ceramic core and at their edges against thermal and electrical insulation constituting a raised annular flange or lip to the base layer. In general at least four members and preferably not more than about 10 members are used. For example, there may be eight such members substantially equally radially spaced around the core at angles of about 45°. It is not, however, essential that these members be arranged in a strictly radially fashion like the spokes of a wheel, that they be straight or that they be separate from one another. Thus, for example, an integral spider-like member having a number of arms extending outwardly from a core will be satisfactory, this core being held down at the centre of the heating element and possibly additionally at the extremities of the arms to retain the latter in place.

These members are made of ceramic, e.g. a thin ceramic rod or tube, so that they are both electrically insulating and capable of withstanding the high radiant temperatures of the heating coil when in operation. They should be relatively thin when the heating unit is viewed in plan so as to make the minimum of interference with the heat radiation from the element or elements to the glass ceramic. Examples of suitable ceramic materials are porcelain and alumina.

The base layer of thermal and electrical insulation provides support for the heating coil substantially throughout its radiant length. This has the advantage of preventing sagging of the bare wire coil which becomes mechanically weak at its operating temperature in radiant cooking units of this type. The base layer of insulation is preferably contained within an outer metal pan both to ensure electrical earthing and to give a protective outer covering to the insulation and unit as a whole. In order to assist in securing the spoke-like members which trap the heating element in place at the centre of the unit, these members can according to one embodiment of the invention be held against a hollow ceramic core which can be the core around which the heating element is wound, by means of a metal retaining disc or washer urged downwardly against the ceramic core by being held through the unit, e.g. by being bolted to the metal pan.

According to one preferred embodiment of the invention the base layer of thermal and electrical insulation has a surrounding upstanding rim which can be integral with the base layer or a separate ring of material. In this way there is defined in the insulating material a circular dish or recess whose overall depth is substantially the same as the overall height of the heating element. Then the spoke-like retaining members can extend over the top of the heating element in contact therewith to the top edge of the rim of insulating material and they can be trapped in place by a separate annular ring of thermal and electrical insulation which provides a spacer between the heating element and the underside of the glass ceramic sheet.

The preferred thermal and electrical insulating material for the base layer is an intimate mixture of microporous silica aerogel, an opacifier and a reinforcing fibre. Other insulating material such as a moulded mass of ceramic fibres can also be used.

There are several methods by which this preferred insulating material can be obtained. For example microporous silica aerogel is a gel in which the liquid phase has been replaced by a gaseous phase in such a way as to avoid the shrinkage which would occur if the gel had been dried directly from a liquid. A substantially identical microporous silica structure can be obtained by controlled precipitation from a silica solution, the temperature and pH being controlled during precipitation to obtain an open structure precipitate. Similar products can be obtained by pyrogenic or electrothermal operations and will be suitable for use if the average ultimate particle size is less than about 100 milli-microns.

The opacifier, which is not always essential, is finely divided titanium dioxide, aluminium oxide, carbon black, or ilmenite.

The reinforcing fibre should desirably have refractory properties and examples of fibres which are useful in the preferred insulating material are of glass, mineral wool, alumino-silicate, aluminia zirconia.

The preferred microporous silica aerogel is formed in a solid compact form of density 8 to 30 lb per cubic foot.

The electrical supply leads for the heating element can extend in a substantially horizontal direction through one or more channels in the top surface of the base layer of insulating material to an electrical connector attached to the side of the heater. This has the advantage over heaters where the electrical leads need to be taken downwardly out of the heater of reducing the spacing required beneath the heater when it is positioned for use and also of reducing heat losses. So as to avoid electrical shorting between the supply leads and the heating coil, the leads can be covered with a ceramic insulating sheath or beads.

In an alternative embodiment the electrical supply lead or leads can be taken in a horizontal direction over the top of the heating element. The lead or leads must be covered with electrical insulation in the form of a sheath or beads of ceramic material. In one arrangement one can use one or more hollow tube-like members for this purpose which can additionally serve as spoke-like members for retaining the heating element in place.

BRIEF SUMMARY OF THE DRAWINGS

A heating unit for a smooth top cooker according to the invention will now be described, by way of example, with reference to the accompanying drawings, in which.

DESCRIPTION OF THE PREFERRED EMBODIMENT

Figure 1:
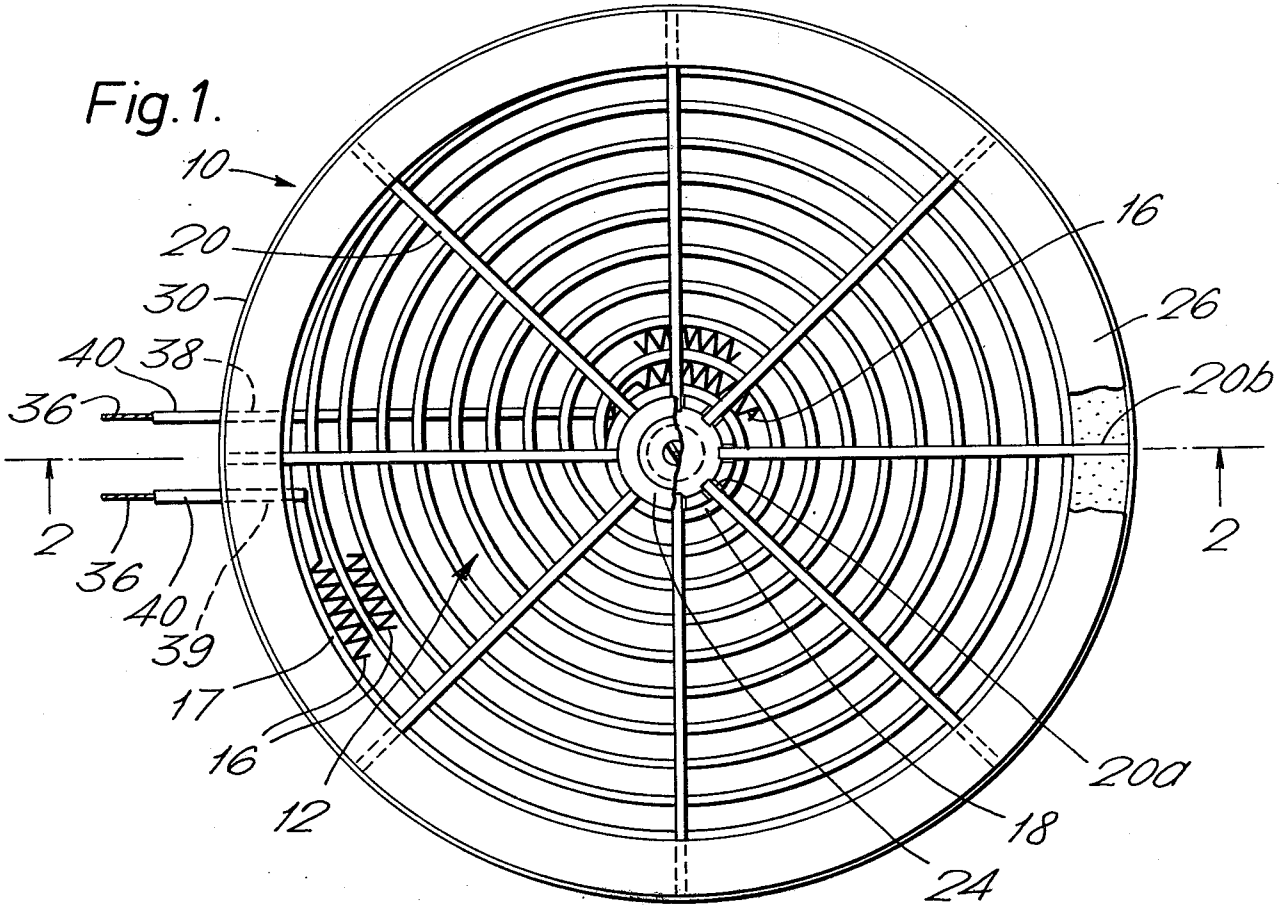
FIG. 1 is a partially broken away plan view.
Figure 2:
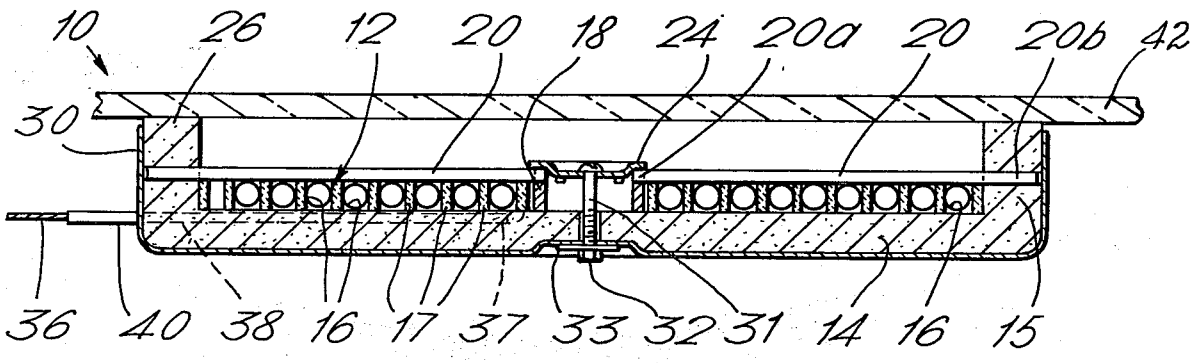
FIG. 2 is a section taken along the line 2—2 of FIG. 1.

The heating unit 10 shown in the drawings comprises an electrical heating element 12 supported on a base layer 14 of thermal and electrical insulation. Around the edge of the layer 14 is an integral upstanding rim or lip 15 defining a circular recess within which the heating element 12 is positioned. This insulation layer 14 is preferably high efficiency, high temperature insulation of the type which we sell under the trade mark Microtherm. This is a compressed mixture of microporous silica aerogel, particulate opacifier and refractory fibre, and, because of its very high insulation properties, the base layer 14 can be relatively thin.

The heating element has been formed by helically winding a spirally coiled bare electrical resistance wire 16 and an adjacent flexible strip 17 of electrical insulation around a central hollow ceramic core 18. The width of the strip 17 is approximately equal to the diameter of the spirally coiled wire 16. In this way a flat, substantially circular heating element is built up with the adjacent convolutions of the coiled wire electrically insulated from one another by the strip 17. The heating element substantially fills the circular recess defined by the rim 15. The flexible strip 17 has to be heat resistant and is a ceramic paper made of aluminosilicate fibres.

In order to hold the convolutions of the heating element in place so as to retain a substantially flat heating element a number of ceramic tubes 20, for example eight are shown in the drawings, are radially arranged above the heating element in a fashion analogous to the spokes of a wheel. The inner ends 20*a* of these tubes 20 are held against the ceramic core 18 by means of a metal washer 24 while the outer ends 20*b* rest on the top surface of the rim or lip 15. These outer ends 20*b* are held against the rim or lip 15 by means of an annular ring 26 of similar thermal insulation material to that of the layer 14, small radial channels (not shown) being provided in the underside of the ring 26 to accommodate the ends 20*b*.

If desired the edge region of the washer 24 can be given a corrugated or like configuration so that each inner end 20*a* is separately trapped and held in the correct angular orientation for the ceramic tubes 20. This is not always essential however.

The underside and side edge of the layer 14, and the side edges of the rim 15 and ring 26 are situated within a metal pan 30. This provides electrical earthing and mechanical protection for these parts.

The washer 24 is held down to trap the inner ends 20*a* of the tubes 20 by means a bolt 31 which passes through the centre of the washer 24 down through the layer 14 and metal pan 30 and onto its free end has been tightened a nut 32. The central region of the metal pan 30 is upwardly domed to accommodate this nut and an associated washer 33 so that they are not significantly proud of the pan 30.

The ends of the electrical resistance heating coil are attached to electrical leads 36. One of these extends from the centre of the electrical heating element in a substantially horizontal direction within a channel 37 in the surface of the layer 14 and through a hole 38 in the rim 15 out through the side of the metal pan 30 to an electrical connector not shown; the other extends from the outer end of the heating element through a bore 39 in the rim 15 and out through the side of the metal pan 30 to the electrical connector. These electrical leads 36 are covered with a ceramic insulating sleeve 40 to prevent shorting with the coils of the heating element.

The heating unit 10 according to the invention is simple and quick to assemble. Because the thickness of the base layer 14 can be the minimum necessary to give electrical and thermal insulation, the overall depth of the unit 10 is relativly small. Thus, the ring 26 must have a certain minimum thickness to ensure that when the heater is in use the overlying glass ceramic sheet 42 is not subjected to too great a thermal shock and the diameter, i.e. the depth, of the heating coil 16 is determined by electrical resistance requirements. However, the thickness of the thermal layer 14 can be significantly less than is the case with the corresponding insulating layer in the heater shown in our U.K. Pat. No. 1,433,378 because there are no metal staples extending in to the layer 14 which require insulation and anchoring in that layer.

Also since the heating coil 16 is not partially embedded in a groove in the layer 14, there is very little thermal mass in addition to the coil itself which has to be heated when the coil is energised. Accordingly the unit can respond quickly to temperature control adjustments.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A smooth top cooker comprising a flat sheet overlying an electrical heating unit, said sheet having an upper surface for supporting a cooking utensil and being transparent to radiant cooking heat from said heating unit, said heating unit including:

a. a core, b. a bare resistance heating wire having a spirally coiled radiant section for operating at a sufficiently high temperature to provide radiant cooking heat to a cooking utensil supported on said upper sheet surface, c. a heat resistant and electrically insulating strip whose width is substantially the diameter of the coil of said spirally coiled radiant section, d. a radiant heating element in the form of a helix of said coiled radiant section and said strip rolled around said core so that adjacent convolutions of said helix are separated by said insulating strip, e. a substantially continuous base layer of thermal and electrical insulating material underlying and supporting said radiant heating element substantially throughout the length of said coiled radiant section, f. an upstanding rim positioned on said base layer beyond the outer edge of said heating element, g. a plurality of spoke-like members of heat resistant and electrically insulating material and of sufficiently thin lateral width to prevent substantial interference with upward heat radiation from said radiant section, said spoke-like members being arranged substantially radially with respect to said core and extending over the top of said heating element with ends projecting beyond the inner and outer edges thereof, said inner ends being supported by said core and said outer ends being supported by said upstanding rim, said core and said rim defining a recess for said heating element such that said spoke-like members are spaced from the upper surface of said base layer by greater than the diameter of said spiral coil to prevent mechanical stress between said spoke-like members and said radiant section, h. retaining means engaging at least one projecting end of said spoke-like members to hold said spoke-like members in position as supported over said heating element by said core and said upstanding rim, said retaining means being positioned so as not to extend over the radiant section of said heating element, and said spoke-like members cooperating with said core and said upstanding rim to retain said heating element in position on said base layer, and, i. means for connecting said bare resistance wire to a source of electrical energy for heating said spirally coiled radiant section to said high radiant temperature.

2. A unit as claimed in claim 1 which further includes electrical supply leads for said heating element extending through the thermal and electrical insulating material of said base layer.

3. A unit as claimed in claim 2 wherein said electrical supply leads extend through said base layer in a direction parallel to the plane of the helix of said radiant heating element.

4. A unit as claimed in claim 1 in which said retaining means includes fastening means for anchoring at least the inner projecting ends of said spoke-like members.

5. A unit as claimed in claim 1 in which said retaining means includes fastening means for anchoring at least the outer projecting ends of said spoke-like members.

6. A unit as claimed in claim 1 in which said spoke-like members radiate outwardly from said core and said retaining means includes fastening means for anchoring the inner ends of said spoke-like members to said core and the outer ends of said spoke-like members to said upstanding rim.

7. A unit as claimed in claim 1 wherein said retaining means includes an inner member comprised of a disc secured to said outer pan by a detachable fastening means.

8. A unit according to claim 1 in which said flexible, heat resistant and electrically insulating strip is a strip of ceramic paper made of alumino-silicate.

9. A unit according to claim 6 in which there are eight spoke-like members equally spaced around said core at angles of about 45°.

10. A unit according to claim 1 in which said spoke-like members are of a material chosen from porcelain or alumina.

11. A unit according to claim 1 in which said upstanding rim is annular and is integral with the base layer.

12. A unit as claimed in claim 1 further comprising an outer pan within which said base layer is positioned.

13. A unit as claimed in claim 12 further comprising a disc bolted to said outer pan for holding the innermost ends of said spoke-like members against said central core.

14. A unit as claimed in claim 1 in which said thermal and electrical insulating material comprises an intimate mixture of microporous silica aerogel, an opacifier and a reinforcing fibre.

15. A unit as claimed in claim 1 further comprising one or more channels in the top surface of said base layer in which electrical supply leads for said heating element are positioned, said channels extending in a substantially horizontal direction to at least one side of the unit, and an electrical connector attached up to the side of the unit to which said electrical supply leads extend.

16. A unit as claimed in claim 1 further comprising an electrical supply lead for the heating element, and wherein at least one of said spoke-like members comprises a sheath of said insulating material which extends across the top of said heating element to the centre of said helix and within which said electrical supply leads extends.

17. A unit as claimed in claim 1 in which said heating element is in two parts, one part being a central helix and the other part being a helically wound annulus surrounding said central helix.

18. A smooth top cooker having more than one electrical heating unit according to claim 1.

19. A unit as claimed in claim 1 wherein said retaining means includes an outer member engaging said outer ends to hold said spoke-like members in position.

20. A unit as claimed in claim 19 wherein said upstanding rim is comprised of an annular ring and the outer member of said retaining means comprises a separate ring of thermal insulating material resting on said annular rim to hold in place the outer ends of said spoke-like members.

21. The smooth top cooker of claim 1 in which said radiant heat transparent sheet is made of a ceramic glass.

* * * * *